United States Patent [19]

Murray

[11] 4,064,610

[45] Dec. 27, 1977

[54] METHOD OF AND MEANS FOR FORMING FLORAL PUFFS

[76] Inventor: Julian W. Murray, 1323 Berkley, Dallas, Tex. 75224

[21] Appl. No.: 725,997

[22] Filed: Sept. 23, 1976

[51] Int. Cl.[2] ..... A41G 1/02; B25B 25/00

[52] U.S. Cl. ..... 29/243.5; 140/149; 156/61

[58] Field of Search ..... 29/243.5, 505; 156/61; 140/149

[56] References Cited

U.S. PATENT DOCUMENTS

| | | | |
|---|---|---|---|
| 948,286 | 2/1910 | Topp | 140/149 |
| 1,470,969 | 10/1923 | Greene | 156/61 |
| 3,822,171 | 7/1974 | Bouillot | 156/61 X |

*Primary Examiner*—Milton S. Mehr

*Attorney, Agent, or Firm*—Joseph H. Schley; Thomas L. Cantrell

[57] ABSTRACT

A novel method of and means for forming puffs for floral arrangements from relatively small sheets of gossamer or net-like, flexible or pliable, very thin, fine mesh fabric or tulle gathered at their medial portions into fluffy butterfly shape, secured by an end portion of a fine wire of extremely small gauge looped around the gathered medial portion of each sheet and twisted upon itself, and having a mechanism for twisting the wire end portion looped around said gathered medial portion of said pliable fine mesh sheet, composed of a helically twisted spindle mounted for axial reciprocation and resiliently biased or restrained in retracted position, guide means for rotating the twisted spindle upon reciprocation thereof, and hook means at the outer end of said spindle for detachably connecting said looped wire end portion and said gathered medial sheet portion thereto whereby said wire portion is twisted upon itself when said wire is gripped and pulled longitudinally outward of said spindle. Also, the floral puff forming means includes a pair of spaced clamp members for overlying and confining a transverse medial portion of each fine mesh sheet upon a supporting surface to facilitate manual gathering of said medial sheet portion.

5 Claims, 4 Drawing Figures

METHOD OF AND MEANS FOR FORMING FLORAL PUFFS

BACKGROUND OF THE INVENTION

In the creation of bouquets, corsages and other floral arrangements, it is customary to fill in the voids between the individual flowers or other portions of the arrangements with small pieces or sheets of gossamer or netlike, flexible or pliable, very thin, fine mesh fabric or gauze, known in the trade as "tulle, " of fluffy butterfly shape which are gathered transversely at their medial portions, which are known as "puffs," and which usually are either rectangular or square, such as 5 × 5 inches or 3 × 6 inches, having about 225 interstices per square inch and being cut from rolls of such fabric or tulle. Heretofore, the fabric or tulle piece or sheet of each floral puff has been manually gathered transversely at its medial portion between the thumb and index or second finger of one hand and attached to a flexible wire of suitable length, such as 9 inches, and extremely small gauge, such as No. 30-26-24, by manual bending or looping of one end portion of the wire around said gathered medial portion of said fabric or tulle sheet. Then, the looped end portion of the fine wire is manually twisted upon itself so as to secure the piece or sheet of fabric or tulle of fluffy butterfly shape to said wire. Since relatively numerous puffs may be required in making floral arrangements, an appreciable expense in involved in the forming of said puffs. Due to the flimsiness and fluffiness of the gathered fabric sheet as well as the length and fineness of the wire, packaging, storing or other accumulation of completed floral puffs is impractical. Accordingly, it is most desirable and more efficacious to form floral puffs at the time of creating each bouquet or other floral arrangement.

SUMMARY OF THE INVENTION

The novel means for carrying out the novel method of this invention facilitates the forming of floral puffs for use in bouquets, corsages and other floral arrangements, being composed of an apparatus or assembly for clamping a flat piece or sheet of the aforesaid fine mesh fabric or tulle against a supporting surface and an assembly or mechanism for twisting a portion or one end of a length of fine wire looped around the medial gathered portion of said sheet of tulle so as to fasten said gathered sheet to the wire. The clamp assembly has a pair of spaced elongate rod-like members or arms pivotally attached to the supporting surface and adapted to be latched thereto, in overlying relationship, for loosely confining a transverse medial portion of one of the tulle sheets to permit manual gathering of said sheet into a fluffy butterfly configuration. The thumb and index or second finger of one hand is placed between the spaced arms of the clamp assembly on either side of the confined sheet and are moved together to gather the medial portion of said sheet therebetween and permit withdrawal thereof from said assembly. Then, a portion or one end of the aforesaid fine wire is looped around the gathered medial portion of the tulle sheet with the other hand. It is noted that the medial sheet of the tulle sheet may be gathered without employing the camp members.

The twisting mechanism is composed of a generally horizontal helical spindle or stem slidably mounted for axial reciprocation and biased or restrained against outward movement by resilient or elastic means, whereby the spindle or stem is maintained in a normal or retracted position except when it is forcibly extended, such as by pulling. The helical spindle comprises an elongate thin narrow member or bar, of metal or other suitable material and generally rectangular in cross-section, twisted or wound on its longitudinal axis so as to have a spiral or twisted ribbon countour or configuration. Stationary guide means is provided at the outer end of the twisted spindle and has a complementary rectangular slot through which said spindle extends, whereby pulling or outward extension as well as retraction of said spindle imparts rotation thereto. A hook is carried by the outer end of the twisted spindle for detachably connecting the looped end portion of the wire to said spindle with the gathered medial portion of the tulle sheet confined within the bight of said wire. By gripping the connected wire and pulling it longitudinally outward of the twisted spindle and away from the guide means, the looped wire end portion is twisted upon itself by the rotation of said spindle resulting from outward reciprocation of the latter.

A cylindrical tube may be provided for the telescopic mounting of the twisted spindle and may have a slotted cap on one of its outer ends for guiding and causing rotation of said spindle upon reciprocation. An elastic element or rubber band may connect the opposite end of the twisted spindle to a post or other stationary member for resisting extension of and for retracting said spindle upon its release. Preferably, a flat plate or board provides the supporting surface for each fabric sheet and has the clamp assembly as well as the tube and post of the twisting mechanism mounted thereon.

DESCRIPTION OF A PREFERRED EMBODIMENT

Figure 1:
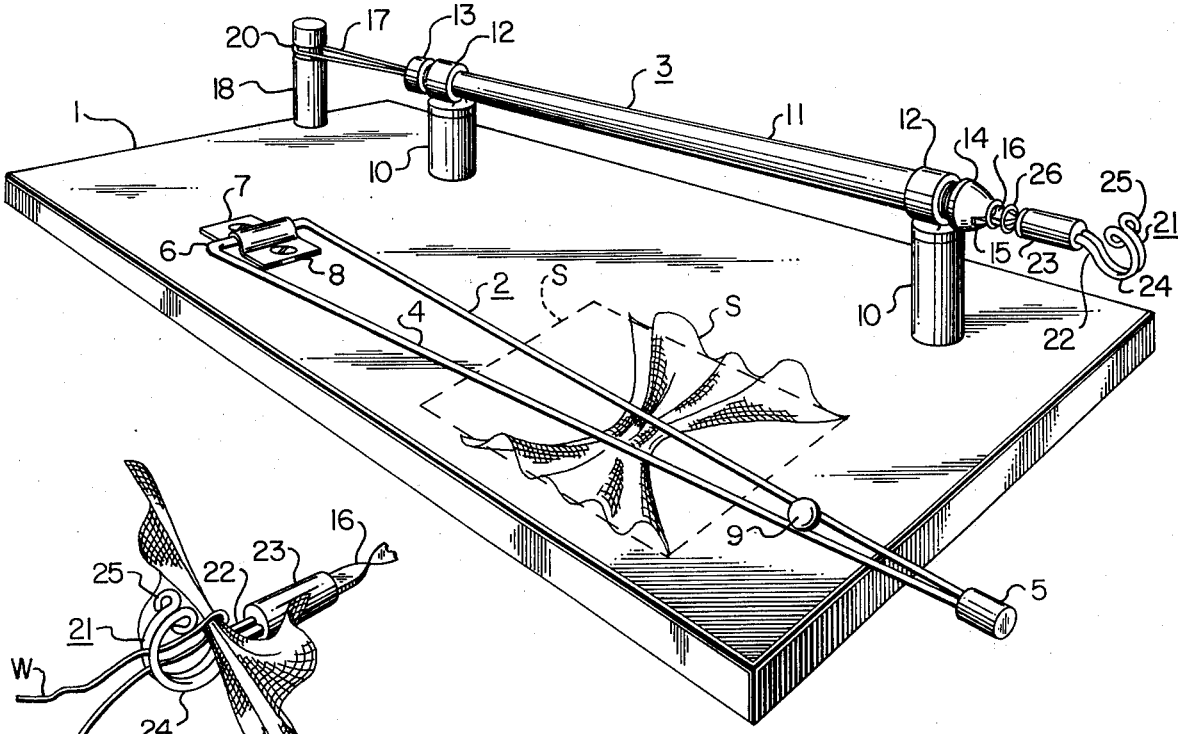
FIG. 1 is a perspective view of floral puff forming means, constructed in accordance with and for carrying out the method of the invention, showing one of the floral puffs underlying the clamp members with its medial portion gathered, the ungathered flat sheet or form of said sheet being shown in broken lines.

In the drawings, the numeral 1 designates the flat rectangular base of floral puff forming means constructed in accordance with the invention for carrying out the method thereof. The base 1, which is of greater length than width, may be of any suitable rigid material, such as wood, composition board, metal or plastic, and has a clamp assembly or apparatus 2 and a wire twisting assembly or mechanism 3 mounted thereon. As shown in FIG. 1, the clamp assembly 2 is composed of a pair of spaced side-by-side elongate rod-like clamp elements or arms 4 extending longitudinally of the base, adjacent one of its lateral margins, and converging outwardly with their outer ends fastened in contiguous relationship by a knob 5 mounted thereon. An integral transverse bight or inner portion 6 connects the inner ends of the clamp arms 4 and is rotatably confined by an overlying hinge bracket 7 fastened by screws 8 to the upper surface or top side of the base 1, whereby the clamp assembly is pivotally secured to said base for swinging movement into and out of engagement with said base. The converging outer end portions of the clamp arms are adapted to straddle the enlarged head or knob of a latch pin or peg 9 which upstands from the base for detachably confining or latching said clamp arms in overlying engagement with said base. Preferably, the outer end portions of the arms 4 and the fastening knob 5 project beyond the end margin of the base 1 adjacent the mounting of the latch pin 9 to facilitate manual gripping of said knob.

Figure 4:
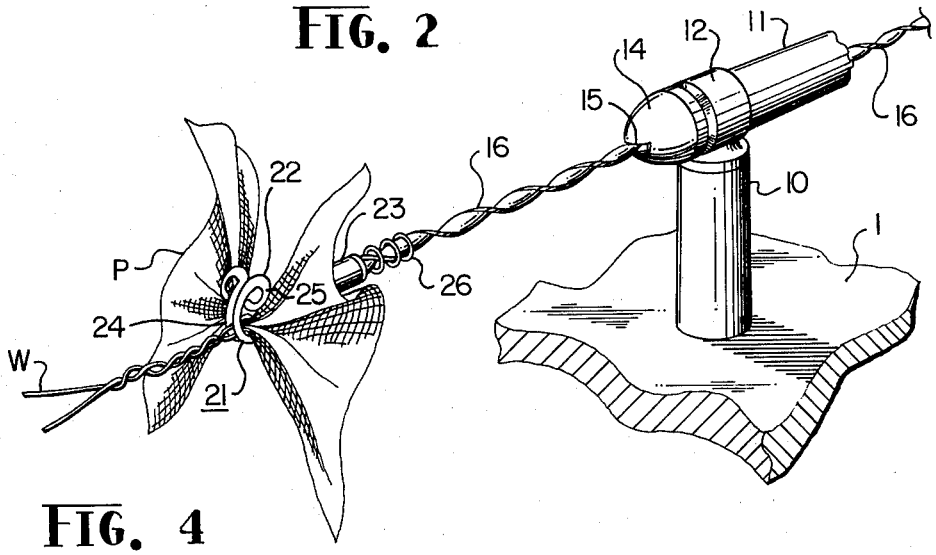
FIG. 4 is a perspective view of the outer end portion of said wire twisting mechanism showing its twisted spindle extended and having one of said completed puffs connected to said hook at said spindle outer end.

As will be clearly apparent hereinafter, the clamp assembly 2 is adapted to simplify the gathering of a transverse medial portion of a relatively small piece or sheet S of gossamer or netlike, flexible or pliable, very thin, fine mesh fabric or tulle, preparatory to forming a floral puff P (FIG. 4) of fluffy butterfly shape for use in floral arrangements, such as bouquets and corsages, to fill the voids between the individual flowers or other portions of said floral arrangements, such as at the margins thereof. Usually, each tulle sheet S is rectangular or square and its size may be 5 × 5 inches of 3 × 6 inches or other suitable dimensions. A fine flexible wire W of suitable length and extremely small gauge is adapted to have one end or a portion bent or looped around the gathered medial portion of each tulle sheet and twisted upon itself to secure said sheet, in its fluffy butterfly shape, to the wire and thereby form a floral puff. Obviously, each floral puff P is adapted to be mounted in a floral arrangement by its wire W.

In using the clamp assembly, its arms 4 are disengaged from contact with the base 1 and from beneath the head or knob of the latch pin 9 by gripping the fastening knob 5 and lifting said arms so as to swing said assembly upward about the horizontal axis of the bight 6. One of the flat tulle sheets S is placed or rested upon the upper surface or top side of the base with a transverse medial portion thereof centered relative to the medial portion of the assembly 2 between its clamp arms when said assembly is latched in overlying relation to said base upon downward swinging of said arms into engagement with said base top side and beneath the knob of the latch pin. The overlying clamp arms 4 frictionally confine the tulle sheet against displacement to an extent sufficient to permit gathering of its transverse medial portion between said clamp arms by the thumb and the index or second finger of one hand as well as pulling of the gathered sheet, in its fluffy butterfly shape, upwardly from between said arms. Accordingly, it is unnecessary to unlatch the clamp assembly until it is desired to form another floral puff P.

Figure 2:
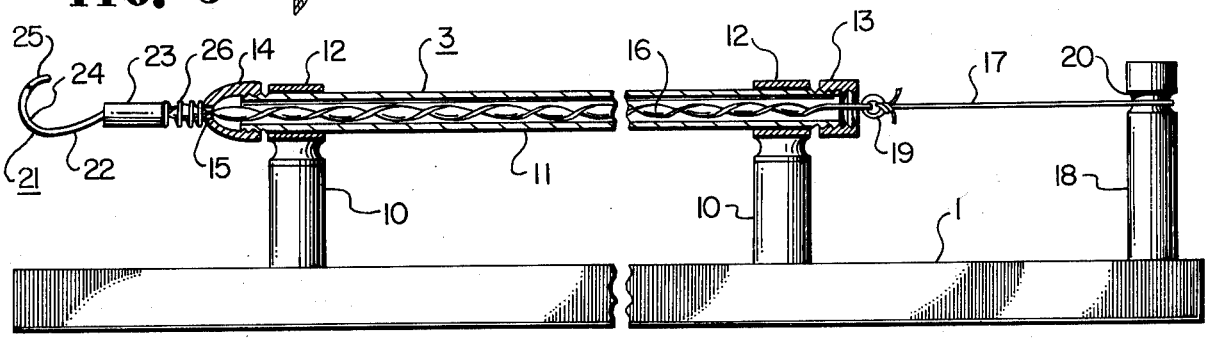
FIG. 2 is a broken side elevational view, partly in section, showing the reciprocal mounting of the twisted spindle of the wire twisting mechanism.

The wire twisting assembly or mechanism 3 includes a pair of spaced upright pillars or posts 10 secured to and upstanding from the base 1 in spaced relation to the clamp assembly 2 and in adjacent relation to the opposite side or lateral margin of said base. An elongate cylindrical housing or tube 11, extending longitudinally of the base, is adapted to be supported by the posts 10 in overlying spaced generally parallel relation to the top side of said base. As best shown in FIG. 2, the housing 11 spans the distance between its supporting posts and has its end portions overlying and projecting therebeyond. An annular yoke or collar 12 may be provided at the upper end of each post 10 for engagement by and suitable connection to the respective adjacent end portion of the cylindrical housing, it being pointed out that the particular mounting of said housing is subject to wide variation. If desired, a decorative collet or ferrule 13 may be screwthreaded or otherwise secured on the inner end of the housing 11. A guide element or cap 14, having a rectangular slot 15 (FIGS. 1, 2) extending transversely of its outer end, is screwthreaded or otherwise fastened on the outer end of the housing, whereby the guide coacts with the collet 13 to confine said housing against longitudinal displacement.

A helically twisted spindle 16, rectangular in cross-section and complementary to the slot 15 of the guide cap 14, is slidably mounted in the housing 11 for relative axial or endwise reciprocation and comprises an elongate slender member or rod, of metal or other suitable material, twisted or wound on its longitudinal axis to provide a spiral or twisted ribbon configuration or contour. One or the outer end of the helical spindle 16 projects through the guide slot 15 of the cap 14 whereby said spindle rotates on its axis when reciprocated relative to the housing. Also, the guide cap and its slot may function as the primary support of the spindle or the sole support of its outer end portion as shown in FIG. 2. For maintaining the spindle 16 in its normal retracted position as well as biasing or resiliently resisting extension thereof, an elastic member or rubber band 17 connects the inner end of said spindle to an upright post 18 upstanding from the base 1 in spaced relation to the post 10 which supports the inner end of the housing. As shown in FIG. 2, a small ring 19 may attach the elastic band 17 to the helical spindle and an annular groove recess 20 may be formed in the exterior of the upper end portion of the post 18 to permit detachable connection of said band to said post by bending or looping therearound.

Figure 3:
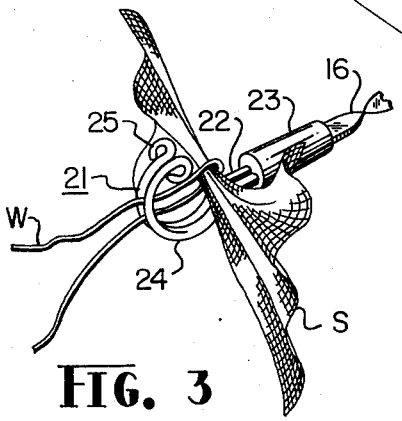
FIG. 3 is a fragmentary perspective view showing a flexible wire looped around the gathered medial portion of said floral puff and engaged with the hook at the outer end of said spindle.

A curved bifurcated hook 21 is mounted on the extremity of the projecting outer end portion of the helical spindle 16 for engagement by the gathered medial portion of one of the tulle sheets S having one of the fine gauge wires W bent or looped therearound as shown in FIG. 3. Preferably, the hook 21 comprises a pair of coextensive flexible contiguous parallel arms or legs 22, of resilient material, having abutting inner end or shank portions confined within a short sleeve or thimble 23 and secured therein or thereby to the spindle extremity. As shown at 24, the medial portions of the hook arms 22 are curved or arced downwardly, then upwardly and then reversely or rearwardly inward, terminating in upstanding external lateral eyes or loops 25. A small helical spring 26 may be confined on the outer end portion of the spindle 16 between the guide cap 14 and thimble 23 for constantly urging said spindle outwardly so as to maintain the elastic band 17 taut and in engagement with the recess 20 of the post 18 as well as to cushion the inward reciprocal movement of said spindle. Outward movement of the spindle is limited by the ring 19 or other enlargement at the inner end of said spindle striking the interior of the guide cap 14 contiguous its slot 15. It is noted that the bifurcation of the hook and the resiliency of its arms facilitate the detachable engagement of each gathered sheet and its looped wire therewith as well as the disengagement of the completed floral puff therefrom.

After gathering of each tulle sheet S at a transverse medial portion thereof into fluffy butterfly shape, by utilizing the clamp assembly 2 (FIG. 1) as explained hereinbefore, or otherwise and the bending or looping of an end portion of one of the fine gauge wires W about said medial sheet portion, said sheet is detachably connected to the bifurcated hook 21 by manually inserting or slipping the looped portion of said wire between the flexible arms 22 of said hook (FIG. 3) with said gathered sheet positioned inwardly or rearwardly of said arms below the external lateral eyes 25 of the latter. This insertion may be made with one of or the second of the hands, which is used to loop the wire, while the gathered medial portion of the sheet is held by the fingers of the first or other of said hands in engagement with the bight or inner end portion of said wire. Upon the aforesaid insertion of the looped portion of the wire W between the hook arms, the fingers of the first hand are released from the gathered medial portion of the sheet S to permit its engagement with and confinement by the arcuate or curved medial portions 24 of said hook arms when said looped wire portion is gripped and pulled longitudinally outward of the housing 11 of the twisting mechanism 3 by the other or second of the hands. The helically twisted spindle 16 and the hook 21 as well as the medially gathered sheet are rotated upon outward movement with the wire so as to twist the looped wire portion upon itself relative to the outer portion or one end of said wire and secure said sheet to said wire in its fluffy butterfly shape, thereby forming one of the floral puffs P for insertion in a floral arrangement. It is noted that the completed floral puff is readily detached from the hook 21 by continued outward pulling of the wire W after the spindle comes to a stop. Due to the resiliency of the flexible arms 22 of the hook, said arms spread apart sufficiently to permit the completed puff to be drawn outwardly from therebetween. Upon this disengagement of the puff P from the hook 21, the force of the elastic band 17 retracts the spindle 16 to its normal inward position.

The foregoing description of the invention is explanatory thereof and various changes in the size, shape and materials, as well as in the details of the illustrated construction may be made, within the scope of the appended claims, without departing from the spirit of the invention.

I claim:

1. Means for forming a puff for a floral arrangement from a flat sheet of relatively thin flexible fine mesh fabric gathered transversely at its medial portion into fluffy butterfly shape and adapted to be secured by a flexible wire of relatively small gauge looped around the gathered medial portion of the sheet and then twisted upon itself comprising an elongate member slidably mounted for axial reciprocation, means for imparting rotation to the elongate slidably mounted member upon relative reciprocation thereof, means for maintaining said member in an inward retracted position and biasing said member against outward reciprocation, and means for detachably connecting a transversely gathered medial portion of a sheet of thin flexible fine mesh fabric and a flexible wire looped therearound to the outer end of said member, whereby the looped wire is twisted upon itself to fasten said wire to the gathered sheet by rotation with said member when the latter is reciprocated outwardly by gripping and pulling said looped wire connected thereto outwardly, the detachable connecting means including a flexible hook having sufficient resiliency to permit separation of the fastened wire and gathered sheet therefrom upon continued outward pulling of said wire and sheet after termination of the outward reciprocation of said member.

2. Floral puff forming means as defined in claim 1 wherein the flexible hook means for detachably connecting the transversely gathered medial portion of the sheet and the wire looped therearound to the outer end of the elongate slidably mounted member having a pair of contiguous flexible elements coextensive therewith for confining said looped wire therebetween, the flexible hook elements being of sufficient resiliency to permit spreading apart thereof for disconnecting the completed floral puff from said hook means.

3. Means for forming a puff for a floral arrangement from a flat sheet of relatively thin flexible fine mesh fabric gathered transversely at its medial portion into fluffy butterfly shape and adapted to be secured by a flexible wire of relatively small gauge looped around the gathered medial portion of the sheet and then twisted upon itself comprising means for frictionally confining a flat sheet of thin flexible fine mesh fabric against a flat surface with at least a transverse medial portion thereof exposed so as to permit gathering of the flat sheet at its exposed transverse medial portion by moving opposed margins of said exposed transverse medial sheet portion together, the gathered sheet being removable from the confining means to facilitate the looping of a portion of a flexible wire around its gathered transverse medial portion, an elongate member slidably mounted for axial reciprocation, means for imparting rotation to the elongate slidably mounted member upon relative reciprocation thereof, means for maintaining said member in an inward retracted position and biasing said member against outward reciprocation, and means at the outer end of said member for detachable connection with said transversely gathered medial sheet portion and the portion of the wire looped therearound, whereby said looped wire portion is twisted upon itself to fasten said wire to said gathered sheet by rotation with said member when the latter is reciprocated outwardly by gripping and pulling said looped wire connected thereto outwardly, the detachable connecting means including a flexible hook having sufficient resiliency to permit disconnection of said fastened wire and gathered sheet from the hook means upon continued outward pulling of said wire and sheet after termination of the outward reciprocation of said member.

4. Floral puff forming means as defined in claim 3 wherein the flexible hook means includes a pair of coextensive contiguous elements for confining the looped wire therebetween and of sufficient resiliency to permit spreading apart thereof and disconnection of the completed floral puff from said hook means.

5. Means for forming a puff for a floral arrangement from a flat sheet of relatively thin flexible fine mesh fabric gathered transversely at its medial portion into fluffy butterfly shape and adapted to be secured by a flexible wire of relatively small gauge looped around the gathered medial portion of the sheet and then twisted upon itself comprising means for frictionally confining a flat sheet of thin flexible fine mesh fabric against a flat surface with at least a transverse medial portion thereof exposed so as to permit gathering of the flat sheet at its exposed transverse medial portion by moving opposed margins of said exposed transverse medial sheet portion together, the gathered sheet being removable from the confining means to facilitate the looping of a portion of a flexible wire around its gathered transverse medial portion, an elongate member slidably mounted for axial reciprocation, means for imparting rotation to the elongate slidably mounted member upon relative reciprocation thereof, means for maintaining said member in an inward retracted position and biasing said member against outward reciprocation, and means at the outer end of said member for detachable connection with said transversely gathered medial sheet portion and the portion of the wire looped therearound, whereby said looped wire portion is twisted upon itself to fasten said wire to said gathered sheet by rotation with said member when the latter is reciprocated outwardly by gripping and pulling said looped wire connected thereto outwardly, said confining means including a clamp pivotally attached to the aforesaid surface for swinging movement into and out of engagement therewith and having a pair of spaced coextensive elements for exposing therebetween at least a transverse medial portion of said gathered sheet when engaged with said surface.

* * * * *